US005286354A

United States Patent [19]

Bard et al.

[11] Patent Number: 5,286,354

[45] Date of Patent: Feb. 15, 1994

[54] METHOD FOR PREPARING ORGANIC AND INORGANIC HYDROXIDES AND ALKOXIDES BY ELECTROLYSIS

[75] Inventors: Allen I. Bard; Hossein Sharifian, both of Austin, Tex.

[73] Assignee: Sachem, Inc., Austin, Tex.

[21] Appl. No.: 45,819

[22] Filed: Apr. 9, 1993

Related U.S. Application Data

[63] Continuation-in-part of Ser. No. 983,052, Nov. 30, 1992, abandoned.

[51] Int. Cl.[5] ..... C25B 1/00

[52] U.S. Cl. ..... 204/86; 204/90; 204/91; 204/92; 204/96; 204/101; 204/102

[58] Field of Search ..... 204/86, 90, 91, 92, 204/96, 101, 102

[56] References Cited

U.S. PATENT DOCUMENTS

| | | | |
|---|---|---|---|
| 3,320,141 | 5/1967 | Cisney et al. | 204/101 |
| 3,402,115 | 9/1968 | Campbell et al. | 204/180 |
| 3,523,068 | 8/1970 | Eisenhauer et al. | 204/72 |
| 4,394,226 | 7/1983 | Wade et al. | 204/72 |
| 4,572,769 | 2/1986 | Shimizu | 204/59 R |
| 4,578,161 | 3/1986 | Buonomo et al. | 204/102 |
| 4,917,781 | 4/1990 | Sharifian et al. | 204/72 |
| 4,938,854 | 7/1990 | Sharifian et al. | 204/130 |

FOREIGN PATENT DOCUMENTS

| | | |
|---|---|---|
| 0420311 | 3/1991 | European Pat. Off. . |
| 9115615 | 10/1991 | PCT Int'l Appl. . |

OTHER PUBLICATIONS

Chemical Abstracts, vol. 109, No. 10, abstract #85225c, p. 832 (1988).

"Electrochemical synthesis of quaternary ammonium hydroxides" by Gomez et al. in Journal of Applied Electrochemistry, vol. 21, pp. 366–367 (1991).

*Primary Examiner*—John Niebling
*Assistant Examiner*—Patrick J. Igoe
*Attorney, Agent, or Firm*—Renner, Otto, Boisselle & Sklar

[57] ABSTRACT

An electrolytic process for making hydroxides or alkoxides from the corresponding halide salts in a divided cell where the desired compounds are formed in the catholyte while the accumulation of halogen in the anolyte is effectively prevented throught the action of a reducing agent added to the acidic anolyte.

32 Claims, No Drawings

METHOD FOR PREPARING ORGANIC AND INORGANIC HYDROXIDES AND ALKOXIDES BY ELECTROLYSIS

CROSS-REFERENCE TO RELATED APPLICATION

This application is a continuation-in-part of copending application Ser. No. 07/983,502, filed Nov. 30, 1992, now abandoned.

BACKGROUND OF THE INVENTION

This invention relates to a method of preparing organic and inorganic hydroxides and alkoxides by electrolysis. The invention also relates to the high purity hydroxides obtained by the method of the invention.

BACKGROUND OF THE INVENTION

Quaternary ammonium hydroxides such as tetramethylammonium hydroxide (TMAH), tetraethylammonium hydroxide (TEAH), tetrapropylammonium hydroxide (TPAH) and tetrabutylammonium hydroxide (TBAH) are strong organic bases that have been known for many years. Such quaternary ammonium hydroxides have found a variety of uses including use as titrants for acids in organic solvents and as supporting electrolytes in polarography. Aqueous solutions of quaternary ammonium hydroxides, particularly TMAH solutions, have been used extensively as a developer for photoresists in printed circuit board and microelectronic chip fabrication. Use of quaternary ammonium hydroxides in the electronics area requires that there be no residue following the normal post-bake period. In electronic applications, it is desirable that the aqueous solutions of quaternary ammonium hydroxides should be essentially free from metal ions such as sodium and potassium, and halides such as chloride, bromide, iodide, etc. Particularly in recent years, there has been an increasing demand for quaternary ammonium hydroxides having a high purity.

Quaternary ammonium hydroxides such as TMAH and TEAH have been produced by various techniques. Generally, the quaternary ammonium hydroxides are manufactured by electrolyzing a salt of a quaternary ammonium compound in an electrolysis cell containing a diaphragm formed of a cation-exchange membrane. The quaternary ammonium salts used in such preparations include halide salts, carboxylate salts, carbonate salts and sulfate salts. When halide salts are used in the manufacture of quaternary ammonium hydroxide, it has been discovered that the quaternary ammonium hydroxide solutions formed by this method generally contain significant amounts of halogen (ionic and latent), generally in concentrations from about 30 ppm up to about 100 ppm at 2.8M quaternary ammonium hydroxide (e.g., TMAH). The term "latent halide" refers to nonionic halogen which is present in the aqueous quaternary ammonium hydroxide solutions and which is capable of forming halide ions under certain conditions such as heating.

Among the prior art patents which describe the preparation of quaternary ammonium hydroxides by electrolyzing a salt of a quaternary ammonium compound are U.S. Pat. Nos. 4,578,161 (Buonomo et al.); 4,394,226 (Wade et al.); 3,523,068 (Eisenhauer et al.); and 3,402,115 (Campbell et al.). In U.S. Pat. No. 4,578,161 a procedure is described wherein an electrolytic cell containing an anionic membrane is used for the production of quaternary ammonium hydroxides. A solution of a tetraalkyl ammonium halide is fed to the cathode compartment and an aqueous solution of ammonium hydroxide is fed to the anode compartment. Upon application of a potential difference across the two electrodes, the halide anions migrate from the cathode compartment to the anode compartment through the membrane. The halide anions react with the ammonium hydroxide in the anolyte compartment forming ammonium halide. Halogen discharge at the anode is prevented by maintaining the pH of the anode compartment greater than 8.

U.S. Pat. No. 3,402,115 describes an electrolytic cell comprising three compartments separated by two membranes, one of which is an anion exchange membrane and the other is a cation exchange membrane. Initially, an acid solution is fed into the anode compartment, the quaternary ammonium salt solution is fed into the central compartment, and a very dilute aqueous solution of quaternary ammonium hydroxide is fed into the cathode compartment. On passage of a current, the tetraalkyl ammonium cations migrate towards the cathode through the cation exchange membrane, and the anion migrates towards the anode through the anion exchange membrane. In U.S. Pat. No. 3,523,068 an electrolytic cell is described which comprises two compartments separated by a cation exchange membrane. Initially, an acid solution of quaternary ammonium salt is fed to the anode compartment, and the anion is selected which will not discharge by electrolysis. Distilled water is supplied to the cathode compartment. On passing a current, the cation passes into the cathode compartment.

Gomez and Estrade in the *Journal of Applied Electrochemistry*, 21 (1991), pp. 365–367 describe a two-compartment electrolysis cell utilizing an anionic selective membrane to separate the two compartments. The catholyte compartment contains a quaternary ammonium halide in water, and the anolyte compartment contains an aqueous or alcoholic solution of HCl or HBr, or NaCl or NaBr. On passing a current, the halide ion migrates from the cathode compartment to the anode compartment across the anion exchange membrane where the halide ion is oxidized to halogen. In the cathode compartment, hydroxyl ions are produced and they substitute for the halide ions forming a quaternary ammonium hydroxide. Some of the halogen formed in the anode compartment attacks the anionic selected membrane gradually, and the remainder of the halogen is emitted from the anode compartment as a gas.

SUMMARY OF THE INVENTION

A process is described for preparing organic and inorganic hydroxides and alkoxides from the corresponding halides in an electrolytic cell which comprises an anolyte compartment containing an anode, a catholyte compartment containing a cathode, and an anion selective membrane or a nonionic divider separating said compartments, said process comprising the steps of (A) charging to the catholyte compartment, a mixture comprising an organic or inorganic halide salt and a liquid selected from water, organic liquids which do not react with hydroxide ions, or a mixture thereof;

(B) charging to the anolyte compartment, a mixture comprising a reducing agent which is capable of reducing halogen or being oxidized at the anode, and a liquid selected from water, organic liquids, or mixtures thereof, provided that sufficient water or alcohol is present in the catholyte mixture during electrolysis to form the desired hydroxide or alkoxide;

(C) passing a current through the electrolytic cell to produce the desired hydroxide or alkoxide in the catholyte compartment; and (D) recovering the organic or inorganic hydroxide or alkoxide from the catholyte compartment.

Quaternary and tertiary onium hydroxides and alkoxides produced by the process of the invention are characterized by improved purity, and production costs are lower than many other processes. The process also is useful particularly for preparing higher molecular weight quaternary and tertiary onium hydroxides and alkoxides.

DESCRIPTION OF THE PREFERRED EMBODIMENTS

In one embodiment, the process of the present invention involves preparing organic and inorganic hydroxides or alkoxides from the corresponding organic and inorganic halide salts in an electrolytic cell. The halide salts may generally be characterized by the formula $$A^+X^-$$

wherein $A^+$ is an organic or inorganic cation, and $X^-$ is a halide anion such as chloride, fluoride, bromide or iodide. A large number of organic and inorganic hydroxides and alkoxides can be prepared from the corresponding halide salts by the process of the present invention.

Examples of inorganic hydroxides and alkoxides which can be prepared from the corresponding halides, include the hydroxides and alkoxides of alkali metals such as sodium and potassium; alkaline earth metals such as magnesium and calcium; transition metals such as titanium, zirconium, chromium, manganese, iron, cobalt, nickel, copper, platinum; rare earth metals such as cerium, neodymium, samarium; etc. Specific examples of inorganic hydroxides which can be prepared in accordance with the process of the present invention include potassium hydroxide, magnesium hydroxide, ferrous hydroxide, ferric hydroxide, cuprous hydroxide, cupric hydroxide, cobaltous hydroxide, cobaltic hydroxide, etc. Examples of the various alkoxides include potassium methoxide, sodium ethoxide, etc. When the inorganic halide is soluble in water or alcohols or mixtures thereof, the mixture which is charged to the catholyte compartment is an aqueous, alcoholic or aqueous alcoholic solution of the metal halide, and when the metal halide is insoluble or at least partially insoluble in water or alcohols, the mixture which is charged to the catholyte compartment may be a suspension, dispersion or emulsion. The insolubles in the aqueous mixture contained in the catholyte compartment are maintained in suspension by agitation.

In another embodiment the process of the present invention involves preparing organic hydroxides and alkoxides such as quaternary ammonium hydroxides or alkoxides, quaternary phosphonium hydroxides or alkoxides and tertiary sulfonium hydroxides or alkoxides from the corresponding quaternary halides in an electrolytic cell. The halides may generally be characterized by the formula $A^+X^-$ wherein $A^+$ is a quaternary ammonium, quaternary phosphonium or tertiary sulfonium cation and $X^-$ is a halide anion such as chloride, fluoride, bromide and iodide.

The quaternary ammonium and quaternary phosphonium halide salts may be characterized by the formula

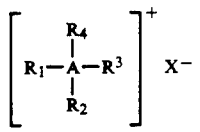

(I)

wherein A is a nitrogen or phosphorus atom, X is a halide and $R_1$, $R_2$, $R_3$ and $R_4$ are each independently alkyl groups containing from 1 to about 20 carbon atoms, hydroxy alkyl or alkoxy alkyl groups containing from 2 to about 20 carbon atoms, aryl groups, or hydroxy aryl groups, or $R_1$ and $R_2$ together with A may form a heterocyclic group provided that if the heterocyclic group contains a C=A group, $R_3$ is the second bond.

The alkyl groups may be linear or branched, and specific examples of alkyl groups containing from 1 to 20 carbon atoms include methyl, ethyl, propyl, butyl, pentyl, hexyl, heptyl, octyl, isooctyl, nonyl, octyl, decyl, isodecyl, dodecyl, tridecyl, isotridecyl, hexadecyl and octadecyl groups. $R_1$, $R_2$, $R_3$ and $R_4$ also may be hydroxyalkyl groups such as hydroxyethyl and the various isomers of hydroxypropyl, hydroxybutyl, hydroxypentyl, etc. In one preferred embodiment, the R groups are independently alkyl groups containing one to ten carbon atoms and hydroxyalkyl groups containing from two to three carbon atoms. Specific examples of alkoxyalkyl groups include ethoxyethyl, butoxymethyl, butoxybutyl, etc. Examples of various aryl and hydroxyaryl groups include phenyl, benzyl, and equivalent groups wherein benzene rings have been substituted with one or more hydroxy groups.

Examples of quaternary ammonium halides representative of Formula I which can be treated in accordance with the process of the present invention to form quaternary ammonium hydroxides or alkoxides include tetramethylammonium chloride, tetramethylammonium bromide, tetraethylammonium chloride, tetraethylammonium bromide, tetrapropylammonium bromide, tetrabutylammonium bromide, tetra-n-octylammonium bromide, trimethylhydroxyethylammonium chloride, trimethylmethoxyethylammonium chloride, dimethyldihydroxyethylammonium chloride, methyltrihydroxyethylammonium chloride, phenyltrimethylammonium chloride, phenyltriethylammonium chloride, benzyltrimethylammonium chloride, benzyltriethylammonium chloride, dimethylpyrolidinium bromide, dimethylpiperidinium bromide, diisopropylimidazolinium bromide, N-alkylpyridinium bromide, etc.

Examples of quaternary phosphonium halides representative of Formula I which can be treated in accordance with the process of the present invention to form quaternary phosphonium hydroxides or alkoxides include tetramethylphosphonium bromide, tetraethylphosphonium bromide, tetrapropylphosphonium bromide, tetrabutylphosphonium bromide, trimethylhydroxyethylphosphonium bromide, dimethyldihydroxyethylphosphonium bromide, methyltrihydroxyethylphosphonium bromide, phenyltrimethylphosphonium bromide, phenyltriethylphosphonium bromide and benzyltrimethylphosphonium bromide.

In another embodiment, the tertiary sulfonium halides which can be treated in accordance with this invention to form tertiary sulfonium hydroxides or alkoxides may be represented by the formula

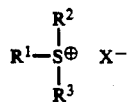

(II)

wherein X is a halide and $R^1$, $R^2$ and $R^3$ are each independently alkyl groups containing from 1 to about 20 carbon atoms, hydroxy alkyl or alkoxy alkyl groups containing from 2 to about 20 carbon atoms, aryl groups, or hydroxy aryl groups, or $R_1$ and $R_2$ together with S may form a heterocyclic group provided that if the heterocyclic group contains a C=S group, $R_3$ is the second bond.

Examples of the halides represented by Formula II include trimethylsulfonium chloride, trimethylsulfonium bromide, triethylsulfonium bromide, tripropylsulfonium bromide, etc.

Mixtures comprising the organic and inorganic halide salts and a liquid which does not react with hydroxyl ions are charged to the catholyte compartment in the process of the invention. The mixtures may be solutions, suspensions, dispersions or emulsions. Preferably the mixtures are solutions containing water-soluble halide salts. The mixtures charged to the catholyte may contain from 3 to about 60% by weight or more of the halide salts.

The mixtures of the quaternary or tertiary onium halides charged to the catholyte compartment also comprise a liquid which does not react with hydroxyl ions. The mixture may be solutions, suspensions, dispersions or emulsions. Solutions are preferred. The concentration of the quaternary or tertiary onium halide in the mixture is between about 3 and 60% by weight and more preferably between about 20 and 40% by weight.

The liquid which is present in the mixture charged to the catholyte compartment (i.e., the catholyte mixture) may be selected from water and organic liquids which do not react with hydroxyl ions. Examples of such organic liquids include hydrocarbons, alcohols, ethers, etc., or mixtures thereof. However, during electrolysis, liquid in the catholyte compartment should comprise sufficient water or alcohol to form the desired hydroxide or alkoxide. More specific examples of liquids which may be used include water, methanol, ethanol, propanol, ethylene glycol, diethylene glycol, hexane, heptane, benzene, toluene, xylene, etc. The mixture charged to the catholyte should not contain significant amounts of any liquid which can react with a hydroxyl group. Examples of such organic liquids which should be avoided in the catholyte mixture include acids, esters, ketones, aldehydes, amides, etc. It is also preferred to avoid any liquid in the catholyte mixture in which the desired hydroxide or alkoxide product is insoluble.

In accordance with the process of the present invention, organic and inorganic halides such as those described above are converted to organic and inorganic hydroxides or alkoxides in an electrolytic cell which comprises an anolyte compartment containing an anode, a catholyte compartment containing a cathode, and an anion selective membrane or a nonionic divider separating said compartments.

Various materials which have been used as anodes in electrolytic cells can be included in the cells used in the process of the present invention provided they do not react with the solution added to the anode compartment. For example, the anode may be made of high purity graphite or metal such as, for example, titanium-coated or clad electrodes, tantalum, zirconium, hafnium or alloys of the same. Generally, the anodes will have a non-passivable and catalytic film which may comprise metallic noble metals such as platinum, iridium, rhenium, rhodium or alloys thereof, or a mixture of electroconductive oxides comprising at least one oxide or mixed oxide of a noble metal such as platinum, iridium, ruthenium, palladium or rhodium.

Various materials which have been used as cathodes in electrolytic cells also can be included in the cells used in the present invention. Cathode materials include nickel, carbon, iron, stainless steel, platinum on titanium, etc. The term "alloy" as used herein is used in a broad sense and includes intimate mixtures of two or more metals as well as one metal coated onto another metal. The above-described anode and cathode materials may be coated or dispersed on a metal or inert substrate to form the desired anode or cathode.

The anolyte and catholyte compartments are separated by a divider which may be an anion selective membrane or a divider which is neither anion or cation selective. The latter type of divider is hereinafter sometimes referred to as a nonionic divider or separator. The dividers function as diffusion barriers or gas separators. Examples of nonionic divider materials include fabrics, sintered glass, glass frits, ceramics, membrane diaphragms, etc.

In one preferred embodiment, the membrane which is utilized in the present invention and which is effective for separating the catholyte compartment from the anolyte compartment is an anion selective membrane or an anion exchange membrane. Any anion selective membrane may be utilized including membranes used in processes for the desalination of brackish water. Preferably, the membranes should be selected which are more selective with respect to halide anions. The preparation and structure of anionic membranes are described in the chapter entitled "Membrane Technology" in *Encyclopedia of Chemical Technology*, Kirk-Othmer, Third Ed., Vol. 15, pp. 92–131, Wiley & Sons, New York, 1985. These pages are hereby incorporated by reference for their disclosure of various anionic membranes which may be useful in the process of the present invention. An example of a strongly basic anion exchange resin which can be used for forming membranes is a polystyrenedivinylbenzene copolymer having as basic functional groups linked thereto, quaternary ammonium or amino groups.

Among the anion selective membranes which may be utilized and which are commercially available are the following: AMFLON, Series 310, based on fluorinated polymer substituted with quaternary ammonium groups produced by American Machine and Foundry Company; IONAC MA 3148, MA 3236 and MA 3475, based on polymer substituted with quaternary ammonium derived from heterogenous polyvinylchloride produced by Ritter-Pfaulder Corp., Permutit Division; Tosflex IE-SF 34 or IE-SA 48 made by Tosoh Corp. which is a membrane designed to be stable in alkaline media; NEOSEPTA AMH, NEOSEPTA AFN or NEOSEPTA ACLE-SP from Tokuyama Soda Co.; and Selemion AMV from Asahi Glass. In one embodiment, the Tosflex IE-SF 34 and NEOSEPTA AMH anion exchange membranes are preferred because of their stability in alkaline solutions such as the quaternary ammonium hydroxide solution which is found in the electrolytic process of the invention.

The electrolytic cell used in the process of the present invention may be any of the known electrolytic cells. The cells may be composed of conventional cell materials which are compatible with the materials being charged into the cells.

In the process of the present invention, the anolyte compartment of the electrolytic cell is charged with a mixture containing a reducing agent which is capable of reducing halogen and/or being oxidized at the anode during the electrolytic process. The mixture also contains at least one liquid selected from water, organic liquids, or mixtures thereof. The catholyte compartment contains a mixture comprising an organic or inorganic halide and a liquid which may be water, an organic liquid which does not react with hydroxide ions or mixtures thereof. When an electrical potential is established and maintained between the anode and cathode to produce a flow of current across the cell, the halide salt in the cathode compartment is ionized, and the halide anions pass from the catholyte compartment through the separator (preferably an anion selective membrane) into the anolyte compartment. Hydroxide or alkoxide ions are generated in the catholyte compartment and combine with the cation to form the desired organic or inorganic hydroxide or alkoxides.

In accordance with the process of the present invention, the anolyte compartment contains a mixture which contains liquid and a reducing agent. Preferably the mixture is an aqueous solution containing a reducing agent and, optionally, an alcohol. The reducing agent is one which is capable of reducing any halogen which is formed at the anode as described above. The reducing agent may also be a composition capable of being oxidized at the anode, and this oxidation is preferential to the oxidation of halide to halogen at the anode thus reducing the amount of halogen or preventing the formation of halogen in the anolyte. It is an object of the present invention to reduce or eliminate halogen present in the anolyte solution. If the halogen is allowed to accumulate in the anolyte compartment, it will begin to attach the membrane, and halogen gas also will be emitted from the anolyte compartment. In accordance with the process of the present invention, the formation and buildup of detrimental amounts of halogen is prevented either because the reducing agent reduces the halogen to halide as it is formed at the anode, or the production of halogen at the anode is prevented or minimized because the reducing agent is preferably oxidized at the anode. The actual mechanism for reducing the amount of halogen in the anolyte solution is not known with certainty and the mechanism may be a combination of both processes described above. Applicants do not wish to be bound by or limited to any mechanism. Examples of compositions that may be utilized as reducing agents include formates, oxalates, hydrazine compounds, hydroxylamine compounds, arsenic (III), antimony (III), uranium (IV), thallium (I), phenol, aniline, mustard gas, 8-hydroxyquinoline, etc.

The hydrazine compounds which may be used as reducing agents in this invention may be characterized by the formula $$R_1N(H)—N(R_2)R_3 \quad (III)$$

wherein $R_1$, $R_2$ and $R_3$ are each independently hydrogen, hydrocarbyl or hydroxy hydrocarbyl groups. Preferably, at least one of $R_1$, $R_2$ and $R_3$ are hydrogen. When each of $R_1$, $R_2$ and $R_3$ is hydrogen, the reducing agent is hydrazine. When one or more of $R_1$, $R_2$ and $R_3$ is hydrocarbyl or a hydroxy hydrocarbyl group, the reducing agent is a substituted hydrazine. The corresponding hydrazine hydrates also may be used to prepare the mixtures useful in the present invention. Although unsubstituted hydrazine ($N_2H_4$) is preferred for reasons of economy and availability, and aqueous hydrazine is preferred for reasons of economy, efficiency and safety, substituted hydrazines (either symmetrical or unsymmetrical) with one or more hydrocarbon or hydroxy hydrocarbon groups are also suitable. As used herein, the term "hydrocarbyl group" refers to alkyl, cycloalkyl, aryl, alkaryl and aralkyl groups. The hydrocarbyl groups may contain other groups which are non-hydrocarbon substituents which do not detract substantially from the hydrocarbon character of the group (e.g., ether, ester, nitro or halogen groups). Such groups are referred to herein as substantially hydrocarbon groups, and these are considered to be equivalent to the corresponding hydrocarbon groups and to be part of this invention.

Examples of substituted hydrazines include methyl hydrazine, N,N-dimethyl hydrazine, N,N'-dimethyl hydrazine, phenyl hydrazine, N-phenyl-N'-ethyl hydrazine, N-(p-tolyl)-N'-(n-butyl)hydrazine, N-(p-nitrophenyl)-N-methylhydrazine, etc.

Various salts of the above-described hydrazine and hydrazine compounds may be utilized and these include, for example, hydrazine acetate, hydrazine monohydrate, hydrazine dihydrochloride, hydrazine monohydrochloride, hydrazine sulfate, etc.

The reducing agent may also be a hydroxylamine compound including hydroxylamine and salts thereof. Examples of hydroxylamine salts include hydroxylamine chloride ($H_2NOH.HCl$), hydroxylamine phosphate ($(H_2NOH)_3.H_3PO_4$) and hydroxylamine sulfate ($(H_2NOH)_2.H_2SO_4$).

The liquid which is included in the mixture charged to the anolyte compartment (i.e., the anolyte solution) may be water, an organic liquid, a mixture of water and organic liquids or mixtures of organic liquids. Almost any organic liquid may be used provided it does not interfere with the desired reactions in the anolyte compartment. Examples of organic liquids include alcohols such as methanol, ethanol, propanol, ethylene glycol, etc.; liquid hydrocarbons such as hexane, heptane, benzene, toluene, xylene, etc.; liquid ethers such as diethylene glycol and triethylene glycol; aldehydes such as acetaldehyde, propionaldehyde, etc.; ketones such as acetone, diethyl ketone, methylethyl ketone, etc.; esters such as ethyl acetate; etc. Water and alcohols are preferred liquids and water is the most preferred.

As noted above, regardless of the liquids selected for use in the catholyte and anolyte mixtures, there must be sufficient water or alcohol present in the catholyte compartment during electrolysis to form the desired hydroxide or alkoxide. The water may be included in the mixture originally charged to the catholyte, or the water may be in the mixture originally charged to the anolyte which diffuses through the divider during electrolysis, or water may be, and preferably is, present in both mixtures. Examples of liquid combinations useful in the present invention are illustrated as follows.

| Liquid Examples | Compartment Catholyte | Anolyte |
|---|---|---|
| A | water | water |
| B | water | $CH_3OH$ |
| C | water | water + $CH_3OH$ |
| D | water | n-heptene |
| E | water | toluene |
| F | water + $CH_3OH$ | water |
| G | $CH_3OH$ | water |
| H | water + $CH_3OH$ | $CH_3OH$ |

When the liquid in catholyte mixture is methanol and the anolyte mixture is water (Example G), some water will diffuse through the divider-membrane to the catholyte compartment and provide hydroxide ions for formation of the desired hydroxide. In this example, the product in the catholyte compartment may be a mixture of the inorganic or organic hydroxide and methoxide. The amount of hydroxide formed will depend on the process parameters such as current density, cell voltage, etc.

In one embodiment, the mixture charged to the anolyte compartment is an aqueous acidic mixture, and generally the pH of the mixture is between about 1 and 7. In another embodiment, the pH of the mixture contained in the anolyte compartment is between about 3 to about 6.5 and in a further embodiment, the pH is from about 4 to about 5.

In one preferred embodiment, the reducing agent comprises an aqueous acidic solution of a formate or oxalate of an alkali metal, alkaline earth metal, transition metal, or ammonium. Alkali metal, alkaline earth metal and ammonium formates are preferred. Specific examples of aqueous acidic solutions useful in the process of the present invention include solutions comprising sodium formate, ammonium formate, potassium formate, magnesium formate, magnesium oxalate, sodium oxalate, etc. The pH of the solution contained in the anolyte compartment may be maintained at or near the desired pH by adding formic acid or dilute ammonium or magnesium hydroxide as needed. For example, the aqueous acidic solution may comprise water and sodium formate adjusted to the desired pH with formic acid. Alternatively, the aqueous acidic solution may comprise water and ammonium formate adjusted to the desired pH with ammonium hydroxide. In another embodiment, the aqueous acidic solution may comprise water and magnesium formate maintained at the desired pH with formic acid.

The electrolysis of the mixture, generally an aqueous solution, containing the organic or inorganic halide salt is effected by applying a current (generally direct current) between the anode and the cathode with a current density of from about 5 to about 250 A/ft$^2$, and more preferably at a current density of from about 25 to about 150 A/ft$^2$. Alternatively, the current density may be from about 100 to about 400 mA/cm$^2$ and more often from about 200 to about 250 mA/cm$^2$. The current is applied to the cell for a period of time which is sufficient to result in the formation of the desired organic or inorganic hydroxide or alkoxide in the catholyte compartment. Circulation is effected by pumping and/or by gas evolution. In practice, the electrolytic cell can be operated batchwise or in a continuous operation.

The following examples illustrate the process of the present invention. Unless otherwise indicated in the following examples and elsewhere in the specification and claims, all parts and percentages are by weight, all temperatures are in degrees Centigrade, and pressure is at or near atmospheric pressure.

EXAMPLE 1

In this example, tetra-n-propyl ammonium hydroxide is prepared from tetra-n-propylammonium bromide using an anion selective membrane in a filter-press cell. The anion selective membrane utilized is Tosflex IE-SF 34-5 made by Tosoh Corp. This membrane is designed to be stable in alkaline media. The cathode is nickel, and the anode is iridium oxide on titanium. Both the anode and cathode are 27.6 cm$^2$. The solution charged to the catholyte compartment is 250 ml of 1.2M (25%) tetra-n-propylammonium bromide. A one-gallon solution of 0.2M sodium formate, adjusted to a pH of 4.0 with formic acid is used as the anolyte. The flow rate for both the catholyte and the anolyte is 305 ml/min. A current of 6 amps (217 mA/cm$^2$) is supplied giving an initial cell voltage of 21 volts which decreases to 16 volts as the temperature rises to about 41° C. After 7 hours, a 32% (1.58M) tetra-n-propylammonium hydroxide solution is obtained. The solution contains 12,800 ppm of bromide and about 5000 ppm of sodium.

EXAMPLE 2

The general procedure of Example 1 is repeated except that the catholyte is a solution of 50% tetrapropylammonium bromide and the electrolysis is conducted for 12 hours. The tetrapropylammonium hydroxide solution obtained in this example contains 850 ppm of bromide.

EXAMPLE 3

In this example, electrolysis is conducted in a filter-press cell equipped with an anion exchange membrane. The anion selective membrane is Neosepta AMH made by Tokuyama Soda Co., Ltd. The cathode is nickel expanded metal, and the anode is graphite. Both the cathode and the anode are 27.6 cm$^2$. The catholyte is a solution of 1.2M (38%) tetrabutylammonium bromide, and the anolyte is a solution of 1.0M ammonium formate maintained at a pH of 5 with ammonium hydroxide. The flow rate for both the catholyte and the anolyte is 305 ml/min., and the temperature is maintained at about 45° C. A current of 217 mA/cm$^2$ (6 Amps) is applied giving an initial cell voltage of 14 volts which decreases to 8 volts as the catholyte tetrabutylammonium hydroxide concentration increases. After about 13 hours, a 1.3M (33%) tetrabutulammonium hydroxide solution is obtained containing 4200 ppm of bromine. The cumulative current efficiency is about 11%.

EXAMPLE 4

The general procedure of Example 3 is repeated except that the anolyte is a solution of 0.3M magnesium formate maintained at a pH of 3.2 with formic acid. The flow rate for both catholyte and anolyte is 305 ml/min, and the temperature is maintained at about 45° C. A current of 217 MA/cm$^2$ (6 Amps) is applied giving an initial cell voltage of 19 volts which decreases to 16 volts as the catholyte tetrabutylammonium hydroxide concentration increases. After about 13 hours, a 1.2M (30%) tetrabutylammonium hydroxide solution is obtained containing about 4200 ppm bromine. The cumulative current efficiency is about 10%.

EXAMPLE 5

The general procedure of Example 3 is repeated except that the catholyte is a 250 ml solution of 1.2M (38%) tetrapropylammonium bromide, while the anolyte is a one-liter solution of 0.4M ammonium oxalate. The pH of anolyte is maintained at about 5 with ammonium hydroxide solution. A current of 6 amps is applied giving an initial cell voltage of 13 V. This rapidly falls to 8.5 V as the concentration of tetrapropylammonium hydroxide in the catholyte compartment increases. After about 4.3 hours, a 0.94M (19%) tetrapropylammonium hydroxide solution is obtained having 0.26M bromide. The cumulative current efficiency is approximately 26%.

EXAMPLE 6

The general procedure of Example 3 is repeated except that the anolyte is an aqueous solution of magnesium formate and formic acid. The catholyte is an aqueous solution of tetramethylammonium chloride in methanol with sufficient water to form the desired hydroxide in the catholyte. At the end of the electrolysis, tetramethylammonium hydroxide in methanol is recovered from the catholyte solution.

EXAMPLE 7

The general procedure of Example 6 is repeated except that the catholyte is a solution of tetramethylammonium chloride in methanol. Due to osmosis some water is transferred from the anolyte compartment to the catholyte compartment thus forming tetramethylammonium hydroxide in methanol in the catholyte.

The process of the present invention provides a method for preparing organic and inorganic hydroxides or alkoxides in water or organic solvents from the corresponding halide salts at reduced cost and improved purity. In addition, almost any type of anion selective membrane can be used for all of the halide salts independent of the nature and molecular weight of the cation since it is the anion ($X^-$) which migrates, not the bulky cation. Thus, it is possible, for example, to prepare a variety of tetraalkylammonium and phosphonium hydroxides or trialkyl sulfonium hydroxides using one apparatus and one type of membrane. The electrolysis can be conducted in such a manner and for a period of time which is sufficient to insure that substantially all of the halide ions migrate to the anolyte compartment which increases the purity of the hydroxide obtained in the catholyte compartment. Another advantage of the process of the present invention is the ability to utilize weakly acid solutions in the anolyte thus reducing corrosion and degradation of the materials of construction.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for preparing organic and inorganic hydroxides or alkoxides from the corresponding halide salts in an electrolytic cell which comprises an anolyte compartment containing an anode, a catholyte compartment containing a cathode, and an anion selective membrane or a nonionic divider separating said compartments, said process comprising the steps of (A) charging to the catholyte compartment, a mixture comprising an organic or inorganic halide salt and a liquid selected from water, organic liquids which do not react with hydroxide ions, or a mixture thereof provided that sufficient water or alcohol is present in the catholyte mixture during electrolysis to form the desired hydroxide or alkoxide;

(B) charging to the anolyte compartment, a mixture having a pH of from about 1 to about 7 and comprising a reducing agent which is capable of reducing halogen or being oxidized at the anode and a liquid selected from water, organic liquids, or mixtures thereof;

(C) subjecting the catholyte mixture and the anolyte mixture to electrolysis by passing a current through the electrolytic cell to produce the hydroxide or the alkoxide in the catholyte compartment, whereby the accumulation of halogen in the anolyte is substantially prevented by the action of the reducing agent; and (D) recovering the organic or inorganic hydroxide or alkoxide from the catholyte compartment.

2. The process of claim 1 wherein the liquid charged to the catholyte is a mixture comprising sufficient water to form the desired organic or inorganic hydroxide.

3. The process of claim 1 wherein the mixture charged to the anolyte comprises the reducing agent and water.

4. The process of claim 1 wherein the liquid in the mixture charged to the catholyte compartment is an alcohol and the liquid in the mixture charged to the anolyte compartment is water.

5. The process of claim 1 wherein the halide salt charged to the catholyte compartment is an organic halide salt characterized by the formula $A^+X^-$ wherein $A^+$ is an organic cation and $X^-$ is a halide anion.

6. The process of claim 1 wherein the halide is a bromide.

7. The process of claim 1 wherein the reducing agent comprises an organic compound or salt which is capable of reducing halogen and/or being oxidized at the anode.

8. The process of claim 1 wherein the reducing agent comprises an oxalate or formate of an alkali metal, alkaline earth metal, transition metal or ammonia.

9. A process for preparing organic and inorganic hydroxides, from the corresponding halide salts in an electrolytic cell which comprises an anolyte compartment containing an anode, a catholyte compartment containing a cathode, and an anion selective membrane or a nonionic divider separating said compartments, said process comprising the steps of (A) charging to the catholyte compartment, an aqueous mixture containing an organic or inorganic halide salt;

(B) charging to the anolyte compartment, an aqueous acidic mixture containing a reducing agent which is capable of reducing halogen and/or being oxidized at the anode;

(C) subjecting the catholyte mixture and the anolyte mixture to electrolysis by passing a current through the electrolytic cell to produce the organic or inorganic hydroxide in the catholyte compartment, whereby the accumulation of halogen in the anolyte is substantially prevented by the action of the reducing agent; and (D) recovering the organic or inorganic hydroxide from the catholyte compartment.

10. The process of claim 9 wherein the halide salt charged to the catholyte compartment is an organic halide salt characterized by the formula $A^+X^-$ wherein $A^+$ is an organic cation and $X^-$ is a halide anion.

11. The process of claim 9 wherein the halide is a bromide.

12. The process of claim 9 wherein the reducing agent comprises an organic compound or salt which is capable of reducing halogen and/or being oxidized at the anode.

13. The process of claim 9 wherein the reducing agent comprises an oxalate or formate of an alkali metal, alkaline earth metal, transition metal or ammonia.

14. The process of claim 9 wherein the pH of the aqueous mixture in the anolyte compartment is from about 1 to about 7.

15. A process for preparing quaternary ammonium hydroxides, quaternary phosphonium hydroxides and tertiary sulfonium hydroxides from the corresponding halides in an electrolytic cell which comprises an anolyte compartment containing an anode, a catholyte compartment containing a cathode, and an anion selective membrane or a nonionic divider separating said compartments, said process comprising the steps of (A) charging to the catholyte compartment, an aqueous solution containing a quaternary ammonium, quaternary phosphonium or tertiary sulfonium halide;

(B) charging to the anolyte compartment, an aqueous acidic mixture containing a reducing agent capable of reducing halogen or being oxidized at the anode;

(C) subjecting the catholyte mixture and the anolyte mixture to electrolysis by passing a current through the electrolytic cell to produce quaternary ammonium hydroxide, quaternary phosphonium hydroxide or tertiary sulfonic hydroxide in the catholyte compartment, whereby the accumulation of halogen in the anolyte is substantially prevented by the action of the reducing agent; and (D) recovering the quaternary ammonium hydroxide, quaternary phosphonium hydroxide or tertiary sulfonium hydroxide from the catholyte compartment.

16. The process of claim 15 wherein the quaternary ammonium halides and quaternary phosphonium are characterized by the formula

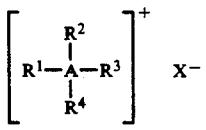

(I)

wherein A is a nitrogen or phosphorus atom, X is a halide, and $R^1$, $R^2$, $R^3$ and $R^4$ are each independently alkyl groups containing from 1 to about 20 carbon atoms, hydroxy alkyl or alkoxy alkyl groups containing from 2 to about 20 carbon atoms, aryl groups, or hydroxy aryl groups, or $R_1$ and $R_2$ together with A may form a heterocyclic group provided that if the heterocyclic group contains a C=A group, $R_3$ is the second bond.

17. The process of claim 16 wherein $R^1$, $R^2$, $R^3$ and $R^4$ are each independently alkyl groups containing from 1 to about 20 carbon atoms.

18. The process of claim 16 wherein $R^1$, $R^2$, $R^3$ and $R^4$ are each independently propyl or butyl groups.

19. The process of claim 16 wherein X is chloride or bromide.

20. The process of claim 15 wherein the tertiary sulfonium halide is characterized by the formula

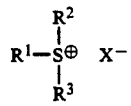

(II)

wherein X is a halide and $R^1$, $R^2$ and $R^3$ are each independently alkyl groups containing from 1 to about 20 carbon atoms, hydroxy alkyl or alkoxy alkyl groups containing from 2 to about 20 carbon atoms, aryl groups, or hydroxy aryl groups, or $R_1$ and $R_2$ together with S may form a heterocyclic group provided that if the heterocyclic group contains a C=S group, $R_3$ is the second bond.

21. The process of claim 15 wherein an anion selective membrane separates said compartments.

22. The process of claim 15 wherein the reducing agent comprises an organic compound or salt which is capable of reducing halide to halide ion and/or being oxidized at the anode.

23. The process of claim 15 wherein the reducing agent comprises an oxalate or formate of alkali metal, alkaline earth metal, transition metal, or ammonia.

24. The process of claim 15 wherein the pH of the aqueous solution in the anolyte compartment is from about 1 to about 7.

25. The process for preparing quaternary ammonium hydroxides from quaternary ammonium halides in an electrolytic cell which comprises an anolyte compartment containing an anode, a catholyte compartment containing a cathode, and an anion selective membrane separating said compartments, said process comprising the steps of (A) charging to the catholyte compartment, an aqueous solution containing a quaternary ammonium halide characterized by the formula

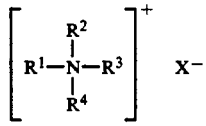

(I)

wherein $R^1$, $R^2$, $R^3$ and $R^4$ are each independently alkyl or hydroxy alkyl groups containing from 3 to about 20 carbon atoms, and X is bromide or chloride;

(B) charging to the anolyte compartment, an aqueous acidic solution having a pH of from about 3 to about 6.5 and containing an alkali metal, alkaline earth metal or ammonium oxalate or formate;

(C) subjecting the catholyte mixture and the anolyte mixture to electrolysis by passing a current through the electrolytic cell to form quaternary ammonium hydroxide in the catholyte compartment, whereby the accumulation of halogen in the anolyte is substantially prevented by the action of the reducing agent; and (D) recovering the quaternary ammonium hydroxide from the catholyte compartment.

26. The process of claim 25 wherein $R^1$, $R^2$, $R^3$ and $R^4$ in Formula I are each independently alkyl groups containing from 3 to about 20 carbon atoms.

27. The process of claim 25 wherein $R^1$, $R^2$, $R^3$ and $R^4$ in Formula I are each independently alkyl groups containing from 3 to about 10 carbon atoms.

28. The process of claim 25 wherein $R^1$, $R^2$, $R^3$ and $R^4$ in Formula I are each independently propyl or butyl groups.

29. The process of claim 25 wherein the concentration of quaternary ammonium halide in the aqueous solution charged in step (A) is from about 3 to about 60% by weight.

30. The process of claim 25 wherein X is bromide.

31. The process of claim 25 wherein the aqueous acidic solution charged in step (B) comprises, in addition to water, an alkali metal or alkaline earth metal formate and formic acid.

32. The process of claim 25 wherein the pH of the solution charged in step (B) is from about 4 to about 5.

* * * * *